US006000568A

United States Patent [19]

Verter

[11] Patent Number: 6,000,568

[45] Date of Patent: Dec. 14, 1999

[54] TAMPER EVIDENT CLOSURE COMPRISING FOLDING SKIRT EXTENSIONS

[75] Inventor: Michael Verter, West Hoxton, Australia

[73] Assignee: GV Engineering PTY Ltd., Kirrawee, Australia

[21] Appl. No.: 09/029,280

[22] PCT Filed: Aug. 30, 1996

[86] PCT No.: PCT/AU96/00540

§ 371 Date: Feb. 27, 1998

§ 102(e) Date: Feb. 27, 1998

[87] PCT Pub. No.: WO97/08071

PCT Pub. Date: Mar. 6, 1997

[30] Foreign Application Priority Data

Aug. 30, 1995 [AU] Australia ..... PN5092
Sep. 5, 1995 [AU] Australia ..... PN5212

[51] Int. Cl.[6] ..... B65D 41/00

[52] U.S. Cl. ..... 215/252; 215/230

[58] Field of Search ..... 215/252, 230

[56] References Cited

U.S. PATENT DOCUMENTS 1,863,796 6/1932 Jackson et al. ..... 215/252
2,133,490 10/1938 Swannell ..... 215/252
2,414,420 1/1947 Sebell ..... 215/252

FOREIGN PATENT DOCUMENTS 2225778 6/1990 United Kingdom ..... 215/252
2240098 7/1991 United Kingdom .
90/05681 5/1990 WIPO .

*Primary Examiner*—Stephen K. Cronin
*Assistant Examiner*—Robin A. Hylton
*Attorney, Agent, or Firm*—Cohen, Pontani, Lieberman & Pavane

[57] ABSTRACT

A thermoplastic closure of the type having an annular internally threaded skirt; an annular skirt extension permanently attached to the skirt adjacent the skirt's lower extremity; one or more discrete arcuate sectors of the skirt extension being configured as flaps permanently affixed to the main body of the skirt extension at a first end being the trailing end during the unscrewing operation and frangibly connected to the main body of the extension at a second end being the leading end of the flap during the unscrewing operation; a container engaging tooth extending towards the container from each flap adjacent its second end; a hinge on each flap intermediate its first end and the container engaging tooth; the container engaging tooth being adapted to override a trigger tooth adjacent a container neck during the running up of the closure onto the container but to lock against the trigger tooth during the unscrewing operation; such locking adapted to break the frangible connection between the main body of the skirt extension and the second end of the flap; the container engaging tooth and second end of the flap being adapted upon further unscrewing of the closure to fold inwardly about the hinge and towards the first end of the flap to a tamper evident position radially inward of the non-folded portion of the flap.

8 Claims, 4 Drawing Sheets

TAMPER EVIDENT CLOSURE COMPRISING FOLDING SKIRT EXTENSIONS

The present invention relates to a tamper evident closure and in particular to a closure and a system for use in relation to a container having an externally threaded neck.

In recent times it has become desirable to design closures such that once a product is enclosed by a manufacturer within a container any subsequent opening of the container is evidenced by the breaking of some part of the closure or attachment thereto.

Many commercially successful tamper evident closures have been designed and where screw threaded containers are involved the most popular designs usually involve a cap having a tamper evident band suspended beneath its skirt. Although such designs have been relatively successful there are problems associated with the unintentional breaking of the small bridges which attach the band to the skirt of the closure which breakage often occurs during the screwing on of the closure rather than the unscrewing of the closure. In some existing designs the tamper evident band becomes a nuisance once it breaks away from the closure as it either falls into the product being dispensed or falls away to create a litter/pollution problem or alternatively just gets in the way. In other designs the tamper evident feature does not provide sufficient visual evidence that a container has been opened as a closure may be resealed and only a very close inspection will reveal that the container has been tampered with.

It is accordingly the object of the present invention to overcome one or more of the deficiencies associated with existing taper evident closures for screw threaded containers or at least to provide the market with an alternative.

According to the present invention there is provided a thermoplastic closure of the type having an annular internally threaded skirt; an annular skirt extension permanently attached to the skirt adjacent the skirt's lower extremity; one or more discrete arcuate sectors of the skirt extension being configured as flaps permanently affixed to the main body of the skirt extension at a first end being the trailing end during the unscrewing operation and frangibly connected to the main body of the extension at a second end being the leading end of the flap during the unscrewing operation; container engaging means extending towards the container from each flap adjacent its second end; hinge means on each flap intermediate its first end and the container engaging means; the container engaging means being adapted to override trigger means adjacent a container neck during the running up of the closure onto the container but to lock against the trigger means during the unscrewing operation; such locking causing the frangible connection between the main body of the skirt extension and the second end of the flap to fracture; and thereafter causing the container engaging means and second end of the flap to fold inwardly about the hinge means to a tamper evident position lying against the radially inner surface of the non-folded portion of the flap; the configuration of the container engaging means and flaps ensuring that once the second end of the flap and container engaging means have folded back as above described then subsequent unscrewing and running up of the closure onto the container will not cause the leading edge of the flap and associated container engaging means to move substantially out of their tamper evident position or to resume their original position.

Figure 1:
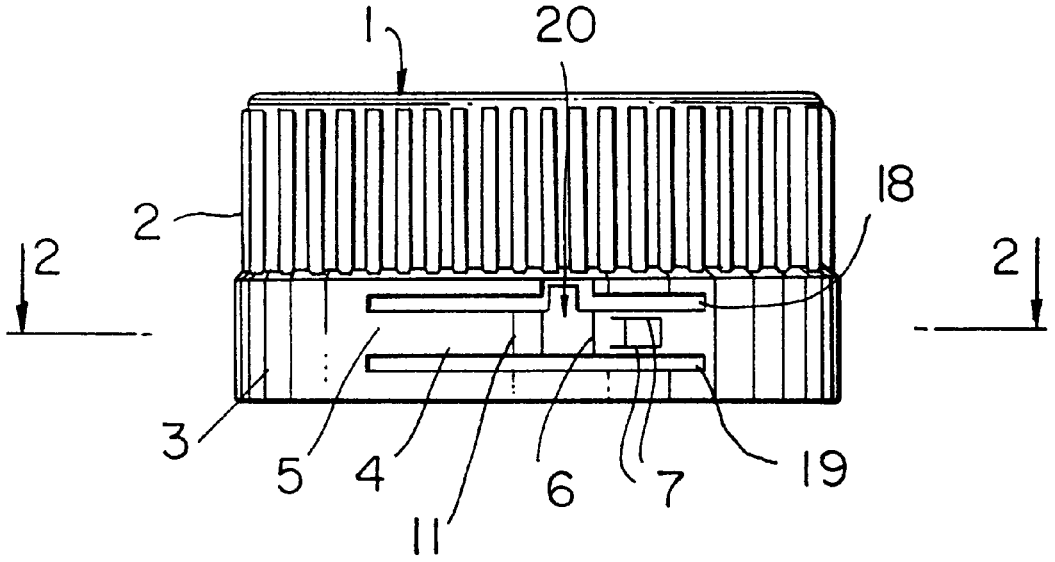
FIG. 1 is a side elevation of a closure in accordance with the present invention.
Figure 2:
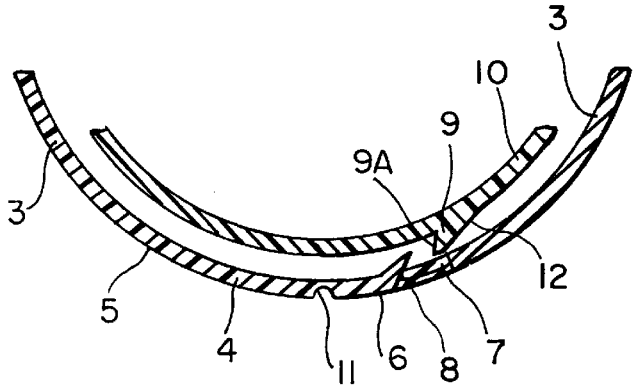
FIG. 2 is a partial section through A—A' of the closure of FIG. 1 and a complementary container prior to closure opening.

Two embodiments of the present invention will now be described with reference to the accompanying drawings.

According to the embodiment of FIGS. 1–6 inclusive there is provided a closure having a top 1 and an annular internally threaded (not shown) skirt portion 2 which is knurled on the outside. Immediately below the skirt portion 2 and of substantially the same external diameter in plan view is a skirt extension 3. In many embodiments the intersection between the skirt and skirt extension may be virtually indistinguishable although the skirt extension should occur beneath the internally threaded portion of the skirt.

Skirt extension 3 incorporates a flap 4 being permanently affixed to the skirt extension 3 at a first end 5 which corresponds to the trailing end of the flap during the unscrewing operation. The second and leading end 6 of the flap is attached to the skirt extension by frangible bridges 7. The second end of the flap is additionally provided with a container engaging tooth 8 adapted to interact with tooth 9 provided on the neck 10 (partially shown) of a container (not shown).

The flap 4 of the embodiment of FIG. 1 is distinguished (inter alia) from the skirt extension 3 of which it initially forms a part by cuts 18 and 19 one above and one below the flap. In the case of other embodiments such as that depicted in FIGS. 7 and 8 hereof the lowermost cut is not necessary as the bottom of the flap also comprises the bottom of the skirt extension.

Figure 3:
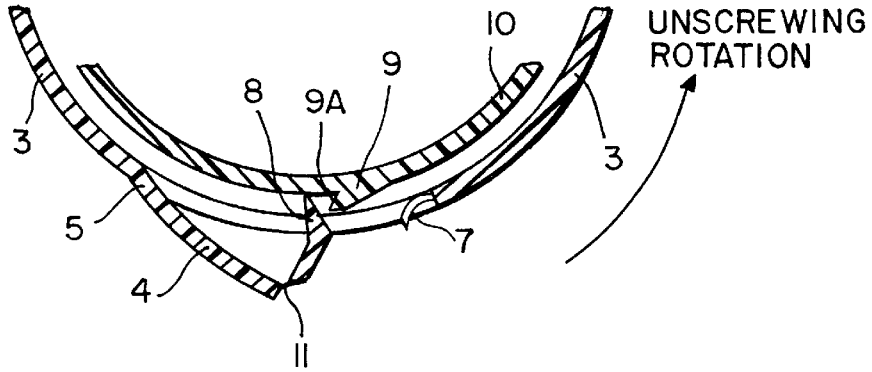
FIG. 3 is a partial section through A—A' of the closure of FIG. 1 and a complementary container during closure opening.

It will be noted from FIG. 3 that during the unscrewing operation the radially innermost and leading edge of tooth 8 abuts an undercut 9A on tooth 9. Further unscrewing of the closure results in fracture of bridge 7 as depicted in FIG. 3 and a movement of flap 4 radially outwardly (as is best viewed from FIG. 3) with respect to the skirt extension 3 and skirt 2 with the flap eventually folding back on itself about hinge 11. As the unscrewing motion continues the leading edge 6 of the flap together with tooth 8 folds back at approximately one hundred and eighty degrees from their original position until they contact the inner surface of that portion of the flap between the hinge 11 and the first end of the flap 5.

Figure 4:
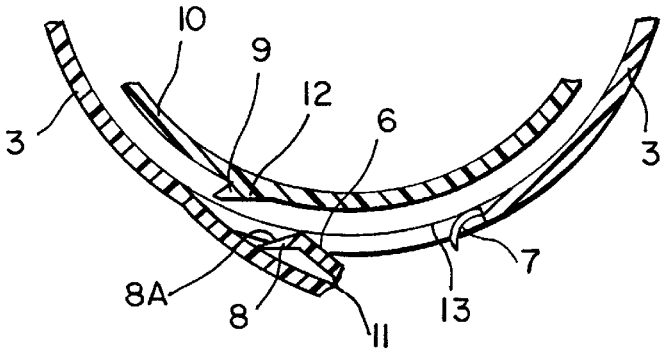
FIG. 4 is a partial section through A—A' of the closure of FIG. 1 and a complementary container after closure opening.
Figure 5:
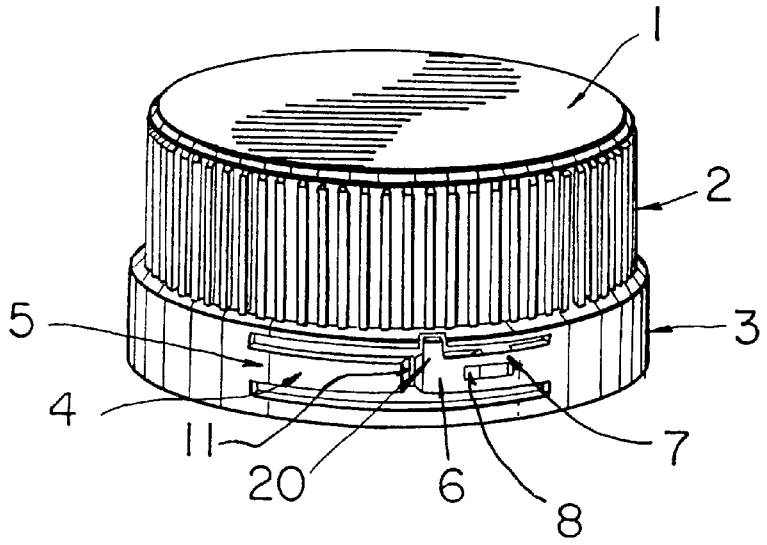
FIG. 5 is a perspective view of the closure of FIG. 1 prior to opening.
Figure 6:
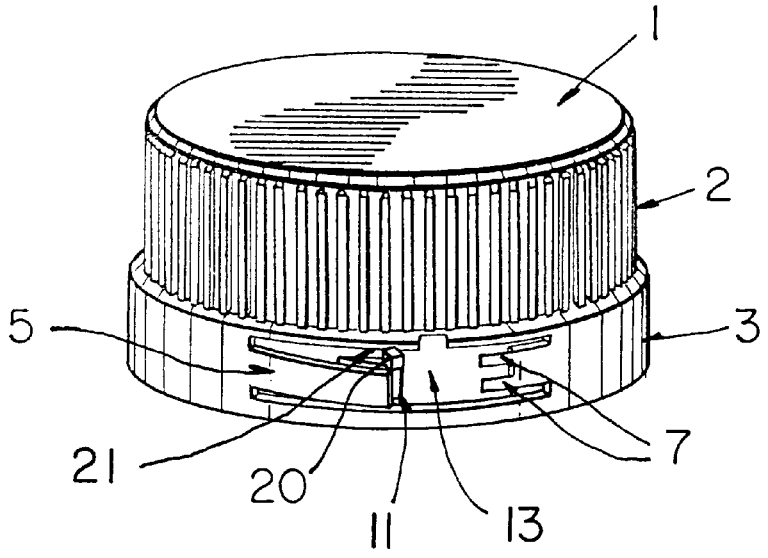
FIG. 6 is a perspective view of the closure of FIG. 1 after opening.

It will be appreciated that reversal of the rotation of the closure from that direction depicted in FIG. 3 such that the closure is again being screwed onto the container results in presentation of a ramp like surface 8A associated with tooth 8 and second flap end 6 being presented to ramp like surface 12 on tooth 9. These two ramp like profiles will override each other and therefore help prevent the second end 6 of the flap and container engaging tooth 8 folding back out of their tamper evident position depicted in FIGS. 4 and 6. It should be appreciated that the position depicted in FIGS. 4 and 6 is a tamper evident position having regard to the hole 13 left in the skirt extension at a position between bridge 7 and hinge 11.

It is also desirable that the thickness of material at hinge point 11 is such that after folding hinge 11 will not possess sufficient memory in order to urge a non-folded portion of the flap between first end 5 and hinge 11 once again radially outwardly after opening of the cap thereby failing to maintain the tamper evident position. Conversely the non-folded portion of the flap between first end 5 and hinge 11 should ideally be fabricated of a material and in such a thickness that it does possess memory characteristics adapted to ensure that after being flexed radially outwardly during the opening operation it seeks to return to its original position substantially aligned with skirt extension 3 in plan view.

In order to further enhance the tendency of the leading edge 6 of the flap to remain folded back at about one hundred and eighty degrees from its original position after opening the leading edge of the flap in the embodiment of FIGS. 1–6 inclusive is provided with tab 20. This tab extends upwardly from the leading edge 6 of the flap (the folding portion) and is adapted to at first move radially outwardly during the unscrewing of the closure and the folding about the hinge but then to move radially inwardly and come to rest adjacent an outer surface 21 of the skirt extension 3 which acts as a stop preventing the memory associated with a non-folding portion of the flap urging the tab any further in a radially inward direction. It will be appreciated from FIG. 6 that tab 20 in conjunction with the memory associated with a non-folding portion of the flap and stop portion 21 of skirt extension 3 serves to maintain the leading edge 6 of the flap and tooth 8 in the tamper evident position.

Figure 7:
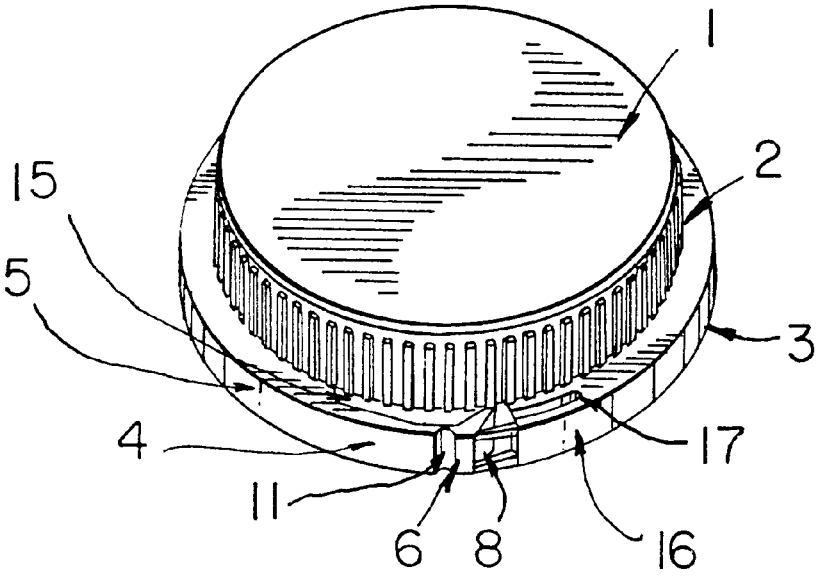
FIG. 7 is a perspective view of an alternate embodiment of the present invention.
Figure 8:
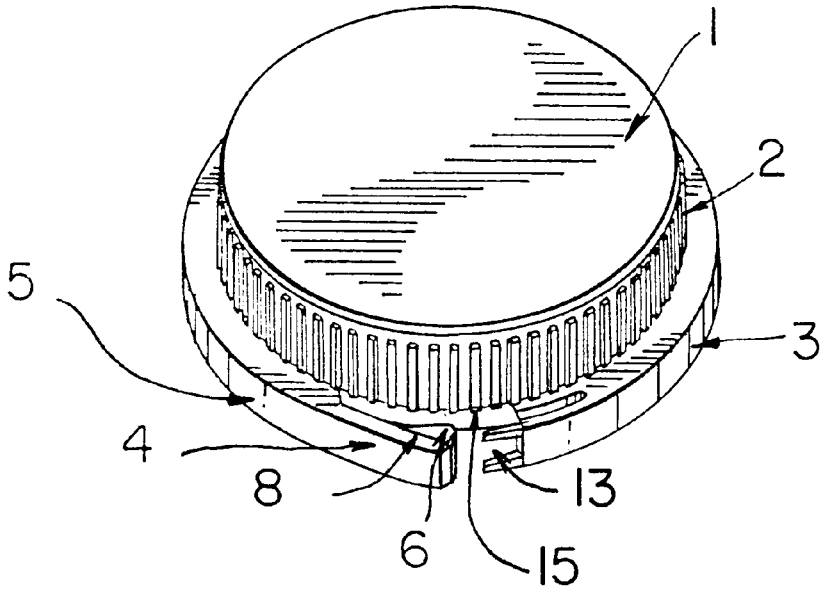
FIG. 8 is a perspective view of the closure of FIG. 7 after opening.

It is possible to design a closure in accordance with the present invention utilising a skirt extension radially outwardly displaced from the bottom of the skirt such that the second end 6 of the flap and container engaging tooth 8 are positively locked into their tamper evidencing position after opening. Such a configuration is depicted in FIGS. 7 and 8 hereof and it will be appreciated that these embodiments rely upon the fact that the lower edge 15 of the skirt 2 extends downwardly to a location below the upper extremity of the skirt extension 3 and more particularly below the upper extremities of the second end 6 of the flap 4 and the container engaging tooth 8. It should also be noted from FIG. 8 that the portion of the flap between first end 5 and hinge 11 which does not fold back about the hinge 11 possesses sufficient resilience and memory such that it tends to reassume its original position as part of the annular skirt extension after temporarily flexing radially outwardly to permit the folding back of its second end 6 and associated container engaging means 8 into the position depicted in FIG. 8. During the folding of the flap about the hinge 11 the hinge 11 moves for a considerable distance radially outwardly as depicted in FIG. 3 before again moving radially inwardly when the folded portion of the flap lies against the inside of the non-folded portion of the flap in the final tamper evident position depicted at FIG. 4. Whilst it is desirable that the non-folded portion of the flap returns to a position as close as possible to its original position aligned with the annular skirt extension it will not be able to completely reassume this position due to the necessity of accommodating the folded portion of the flap between the non-folded portion and the container.

In order to assist the container engaging tooth 8 to override tooth 9 on the container during the original running up of the closure onto the container portion 16 of the skirt extension 3 on the opposite side of frangible bridge or bridges 7 to the flap 4 is configured as a tongue separated from the main body of the skirt extension and/or cap by cut 17. Cuts 18 and 19 also extend into a corresponding position in the embodiment of FIGS. 1–6 for the same reason.

Examples of the closure in accordance with the present invention which have been manufactured to date utilise two flaps radially separated by about one hundred and eighty degrees each provided with one tooth comprising the container engaging means. It is envisaged that the containers for use in conjunction with closures of the present invention may be provided with approximately six to twelve radially spaced trigger means in order that the tamper evident feature of the closure may be triggered by a limited movement of the closure.

It will be appreciated that alternate embodiments apart from those two above described may be devised and are intended to fall within the scope and intendment of the present invention.

The claims defining the present invention are as follows:

1. A thermoplastic closure having an annular internally threaded skirt having a lower end; an annular skirt extension permanently attached to the skirt adjacent the skirt's lower end; at least one discrete arcuate sector of the skirt extension formed as flaps permanently affixed to a main body of the skirt extension at a first end, said first end being the trailing end during an unscrewing operation and frangibly connected to the main body of the extension at a second end, said second end being the leading end of the flap during the unscrewing operation; said flaps having an uppermost end and container engaging means extending towards the associated container from each flap adjacent its second end; hinge means on each flap intermediate its first end and the container engaging means; the container engaging means being overriding trigger means on the closure adjacent the associated container neck during application of the closure onto the associated container but to lock against the trigger means during the unscrewing operation; said locking breaking the frangible connection between the main body of the skirt extension and the second end of the flap; the container engaging means and second end of the flap folding inwardly about the hinge means and towards the first end of the flap to a tamper evident position radially inward of a non-folded portion of the flap upon further unscrewing of the closure.

2. A thermoplastic closure in accordance with claim 1 wherein the non-folded portion of the flap accommodates radially outward movement of the hinge during the unscrewing operation yet possesses sufficient resilience and memory to resist radially outward movement of the hinge after the tamper evident position is achieved; means being provided to restrain the folding portion of the flap into the tamper evident position lying against the radially inner surface of the non-folded portion of the flap once the closure has been removed from a container.

3. A thermoplastic closure in accordance with claim 1 wherein the annular skirt extension is substantially co-extensive with the skirt, and the skirt and skirt extension have substantially the same diameter.

4. A thermoplastic closure in accordance with claim 1 wherein the annular skirt extension is affixed to the lower extremity of the skirt but is stepped out therefrom with the annular skirt extension having a substantially greater diameter than that of the skirt.

5. A thermoplastic closure in accordance with claim 4 wherein the folded portion of the flap is restrained into its folded tamper evident position after opening of the container due to a portion of the skirt extending downwardly to a position below the uppermost end of the folded portion of the flap adjacent its free end; the folded portion of the flap after opening not being free to move radially inwardly in order to reassume its original unfolded position; any unfolding of the folded portion of the flap necessitating urging of the unfolded portion of the flap radially outwardly away from its equilibrium position.

6. A thermoplastic closure in accordance with claim 1 wherein the container engaging means extending towards the container from each flap comprises a ramped projection having an undercut adjacent its leading edge.

7. A thermoplastic closure system in accordance with claim 1 including a container having radially outwardly directed protrusions beneath an externally threaded neck engaging the container engaging means of the closure during an unscrewing operation but not during application of the closure onto the associated container.

8. A thermoplastic closure having an annular internally threaded skirt having a lower end; an annular skirt extension permanently attached to the skirt adjacent the skirt's lower end; at least one discrete arcuate sector of the skirt extension forming flaps permanently affixed to a main body of the skirt extension at a first end, said first end being the trailing end during an unscrewing operation and frangibly connected to the main body of the extension at a second end, said second end being the leading end of the flap during the unscrewing operation; container engaging means extending towards an associated container from each flap adjacent its second end; hinge means on each flap intermediate its first end and the container engaging means; the container engaging means overriding trigger means on the closure and adjacent the associated container neck during application of the closure onto the associated container but locking against the trigger means during the unscrewing operation; said locking of the container engaging means and the closure trigger means breaking the frangible connection between the main body of the skirt extension and the second end of the flap; the container engaging means and second end of the flap folding inwardly about the hinge means and towards the first end of the flap to a tamper evident position radially inward of a non-folded portion of the flap upon further unscrewing of the closure; the non-folded portion of the flap accommodating radially outward movement of the hinge during the unscrewing operation yet having sufficient resilience and memory to resist radially outward movement of the hinge after the tamper evident position is achieved; means being provided to restrain the hinge means of the flap into the tamper evident position lying against the radially inner surface of the non-folded portion of the flap once the closure has been removed from the associated container; the restraining means comprising a tab extending upwardly from the folding portion of the flap between the hinge portion and its second end; said tab when in the tamper evident position resting against the radially, outermost surface of a stop on one of the skirt and skirt extension aligned therewith; the stop preventing the tab and hence the container engaging means moving from radially inwardly from the tamper evident position; the tab being urged against the stop by the non-folded portion of the flap when in the tamper evident position.

* * * * *